US007258565B2

(12) United States Patent
Huang et al.

(10) Patent No.: US 7,258,565 B2
(45) Date of Patent: Aug. 21, 2007

(54) USB CONNECTOR ASSEMBLY

(75) Inventors: Shang-Yen Huang, Taipei Hsien (TW); Sheng-Ho Yang, Taipei Hsien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 11/366,562

(22) Filed: Mar. 3, 2006

(65) Prior Publication Data

US 2006/0148300 A1 Jul. 6, 2006

Related U.S. Application Data

(63) Continuation-in-part of application No. 11/011,105, filed on Dec. 15, 2004, now abandoned.

(30) Foreign Application Priority Data

Jun. 18, 2004 (TW) ..... 93209645 U

(51) Int. Cl.
*H01R 13/627* (2006.01)

(52) U.S. Cl. ..... 439/353

(58) Field of Classification Search ..... 439/350–358, 439/607, 108

See application file for complete search history.

(56) References Cited

U.S. PATENT DOCUMENTS

| | | | | |
|---|---|---|---|---|
| 6,290,530 | B1 * | 9/2001 | Chang | 439/378 |
| 6,508,678 | B1 * | 1/2003 | Yang | 439/677 |
| 6,652,317 | B2 * | 11/2003 | Shao | 439/607 |
| 6,896,527 | B1 * | 5/2005 | Peng | 439/108 |
| 6,902,432 | B2 * | 6/2005 | Morikawa et al. | 439/607 |
| 7,128,595 | B2 * | 10/2006 | Boutros | 439/358 |

* cited by examiner

*Primary Examiner*—Chandrika Prasad
(74) *Attorney, Agent, or Firm*—Troxell Law Office PLLC

(57) ABSTRACT

A USB connector includes a plug comprising an insulative member, a mating member, a first conductor assembly, two elongate flexible members, a metal case member comprising inner and outer pieces, and a plastic housing for enclosing the case member and comprising upper and lower shells; and a jack comprising a shield shell, an insulative unit, and a second conductor assembly. The flexible long member includes a U-shaped member formed by bending its one end, a claw at the other long end, a toothed member at one end, a protuberance proximate the U-shaped member opposite the toothed member, and a flexible arm extended between the claw and the protuberance. Inserting the arms through the insulative member will sandwich either claw between a latch and the shield shell, rest the arms on grooves, fasten the protuberances in slots, and fasten the toothed members in tunnels for assembling a main portion of the plug.

3 Claims, 11 Drawing Sheets

USB CONNECTOR ASSEMBLY

This is a continuation-in-part of U.S. patent application Ser. No. 11/011,105, filed on Dec. 15, 2004 now abandoned in the names of Huang, Shang-Yen and Yang, Sheng-Ho and entitled "ELECTRICAL CONNECTOR WITH LATCHING DEVICE" is now pending.

BACKGROUND OF THE INVENTION

1. Field of Invention

The present invention relates to electrical connectors and more particularly to a mini-USB (Universal Serial Bus) connector having an improved, enhanced latching arrangement for insuring a reliable electrical connection of plug and jack thereof.

2. Description of Related Art

Reliable securing of an electrical connector in a port or to a mated connector is very important. For example, a mini-USB connector comprises a projection (or so-called plug) and a port (or so-called jack). Each of the plug and jack comprises an insulative body, a conductor assembly in the body, and a metal housing for enclosing the body.

However, the coupled plug and jack tend to become loose because for example the plug, attached to a cable, is provided externally to a coupled device and is thus subject to disengagement by pulling the cable. This can cause a poor electrical contact. However, the mini-USB connector incorporating the conventional construction cannot ensure a reliable connection because a resilient member of the plug may suffer elastic fatigue after a predetermined number of times of use and the coupling of the plug and jack may be compromised by inadvertently pulling the cable.

U.S. Pat. No. 6,902,432 describes a USB connector for interconnecting a computer and a peripheral and comprises a jack fixed to a circuit board and a plug provided at an end of a cable extended from the peripheral. The jack comprises a shield shell including a tongue having a V-shaped bent end on a top face, two grooves adjacent both sides of the tongue, and two cantilever shield contacts having a V-shaped bent end formed in the grooves. The plug comprises a housing body, a shield case projected from a front end of the housing body, and a rear electrical wire electrically connected to the shield case through the housing body. The housing body comprises a top hinged push member. The shield case comprises a top depression and two parallel flexible pieces spaced from the depression. Either flexible piece has a claw at its open end. The flexible pieces can be pressed down by two bottom projections at a front end of the push member by pressing the push member. In response to inserting the plug into the jack and electrically connecting the plug terminal to the jack terminal, the claws are fastened by the ends of the shield contacts and the end of the tongue is inserted in the depression.

The patent, however, is still somewhat complex in constructions. Thus, continuing improvements in the exploitation of USB connector are constantly being sought.

SUMMARY OF THE INVENTION

It is therefore an object of the present invention to provide a USB connector comprising a plug at one end coupled to a cable extended from a peripheral, the plug comprising an insulative member, a mating member, a first conductor assembly, two elongate flexible members, a metal case member comprising an inner piece and an outer piece, and a plastic housing for enclosing the case member and comprising an upper shell and a mated lower shell; and a jack fixed to a circuit board and adapted to couple to the other end of the plug, the jack comprising a shield shell, an insulative unit, and a second conductor assembly; wherein the insulative member comprises a rectangular body including a connecting element, a first cavity, two upper projections at both sides of the connecting element, a first protrusion provided between the upper projections, two lower projections provided at both sides of the connecting element, the lower projection including an inner tunnel, two slots provided on both sides of a top of the connecting element, two recesses each formed between the upper and lower projections and at either side and disposed above the tunnel, and a connecting member opposite the body and including a plurality of parallel top channels in communication with the first cavity; the mating member comprises a rear enlarged seat including an intermediate dent, two side indentations, and two first projections each disposed between the indentation and the dent, and a front flat plate including a second protrusion, an adjacent first tab at either side of the rear seat, an underside first trough, and two elongate first grooves at both sides; the first conductor assembly comprises a plurality of upper and lower conductors each having a contact portion, a fixing portion, a bending portion, and a solder portion of U section; the flexible member comprises a U-shaped member formed by bending its one end, a claw at the other end, a toothed member at one end, a protuberance proximate the U-shaped member opposite the toothed member, and a flexible arm extended between the claw and the protuberance; the inner piece comprises a front member, a rear member including two first latches on its top, a slit provided along its either top edge for positioning the protuberance, and two second openings on either side of the rear member, a ramp for connecting the front and rear members and together, an arcuate member extended from one end of the rear member, a space defined by the front member to receive the mating member, an opening on a top of the front member, and a slit at either side of the front member; the outer piece comprises two side second latches, a plurality of bottom second tabs, two opposite front members, and a rear bent member; the upper shell comprises a third latch extended downwardly from either first sidewall, four corner pegs, and a top push member; the lower shell comprises four corner holes with the pegs inserted thereinto, two upright side fourth latches, two inner side wells, and an inner bottom bar; the insulative unit comprises an intermediate wall, two flat side guides at one end, a mating element at the other end, a plurality of parallel second grooves on the mating element, a plurality of parallel apertures in the mating element, two side rails proximate the guides, and two side supports; the shield shell comprises two second sidewalls, a top face interconnecting the second sidewalls, a first slot member on the top face, a first cantilever member having a V-shaped groove in the first slot member, two second slot members each being smaller than the first slot member and disposed at either side thereof, two second cantilever members having an upward bent end in the second slot member, an extending direction of the first cantilever member being opposite to that of either second cantilever member, a third opening having a reduced bottom for receiving the insulative unit, a bent extension at the other end having a second cavity at its either end, two third protrusion each projected from the second sidewall to the second cavity, two flat mounting legs extended laterally from either second sidewall to mount on the circuit board, and two side second troughs; the second conductor assembly comprises a plurality of elongate parallel conductors each including a flat first terminal, a first portion adjacent the first terminal extended from the apertures, a bent second terminal rested on the second grooves, and an intermediate enlarged portion; in an assembly of the USB connector insert the first conductor assembly in the cavity with the contact portion of each conductor thereof inserted through the enlarged seat of the mating member, and the bending portion and the U-shaped portion of each conductor thereof fastened in the first cavity and the top channel respectively; assemble the second conductor assembly, the insulative unit, and the shield shell together with the conductors of the second conductor assembly disposed in the apertures, the insulative unit enclosed by the shield shell, the rails lockingly received in the second troughs, and the third protrusions latched in the second cavities; urge the mating member against the insulative member to matingly engage the indentations, the dent, the first projections, and the second protrusions with the upper projections, the first protrusion, and the recesses of the insulative member, and insert the first tabs into the tunnels; insert the claws and the arms of the flexible members through the recesses of the insulative member to sandwich either claw in a gap between the upward bent end of the second cantilever member and the shield shell in the second slot member, rest the arms on the first grooves, fasten the protuberances in the slots, and fasten the toothed members in the inner tunnels; couple the inner piece and the above assembled components together; couple the inner piece and the outer piece together with the second and first latches and inserted into the second openings, the first and second latches and the second tabs lockingly urged against the above assembled components, the front member lockingly received between the front members, and the cable being clamped by the bent member; and enclose the above assembled components in the housing and fasten them together by snapping the upper shell to the lower shell with the push member being urged by the protuberances of the flexible members with the fourth latches inserted in the upper shell, the third latches inserted in the lower shell, and the first and second conductor assemblies and electrically connected together; whereby pressing the push member to exert a force on the protuberances will lower and cause the claw to clear the gap between the upward bent end of the second cantilever member and the shield shell in the second slot member prior to separating the jack from the plug.

The above and other objects, features and advantages of the present invention will become apparent from the following detailed description taken with the accompanying drawings.

DETAILED DESCRIPTION OF THE INVENTION

Figure 1:
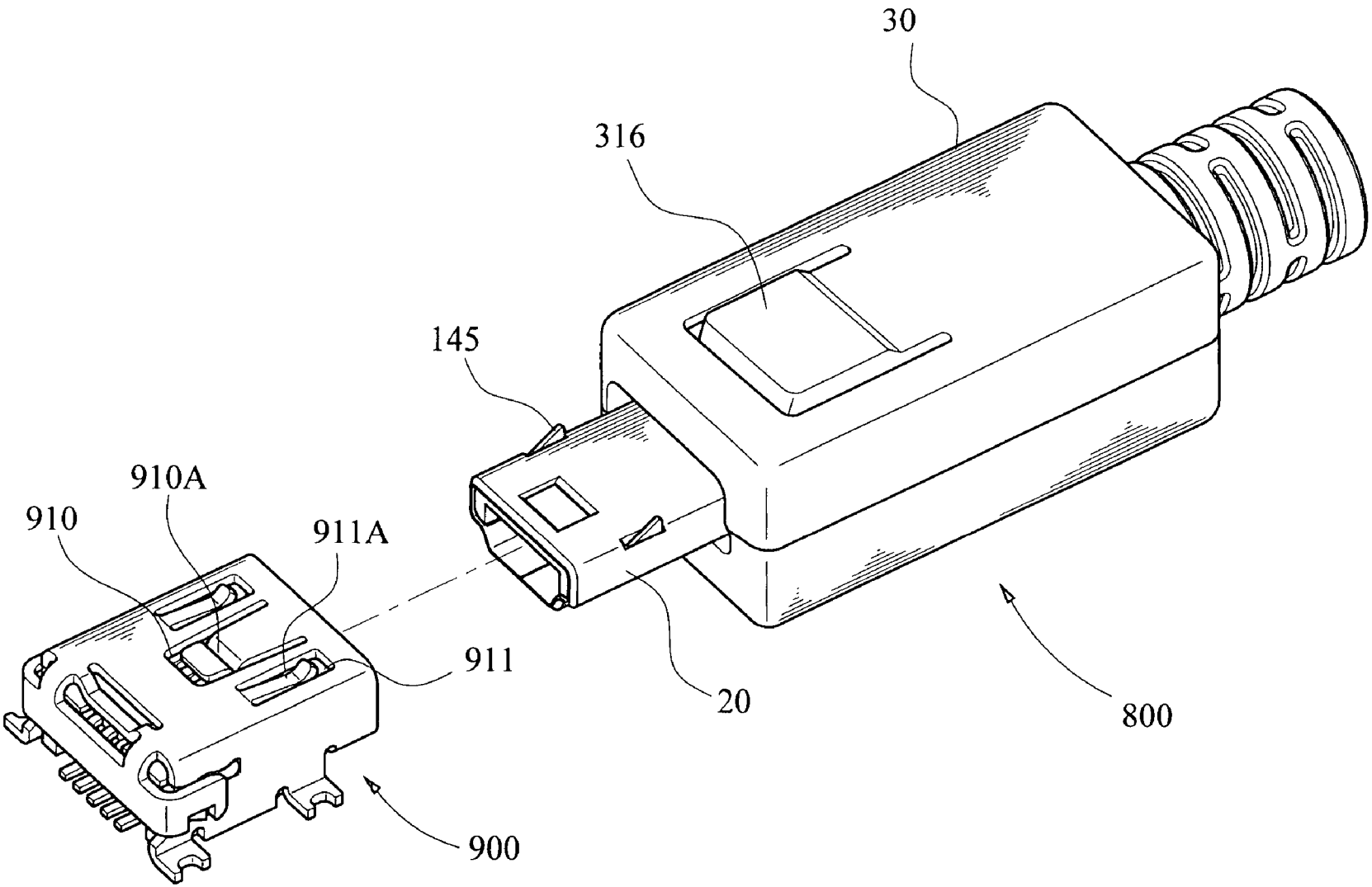
FIG. 1 is an exploded perspective view of a preferred embodiment of USB connector according to the invention.
Figure 2:
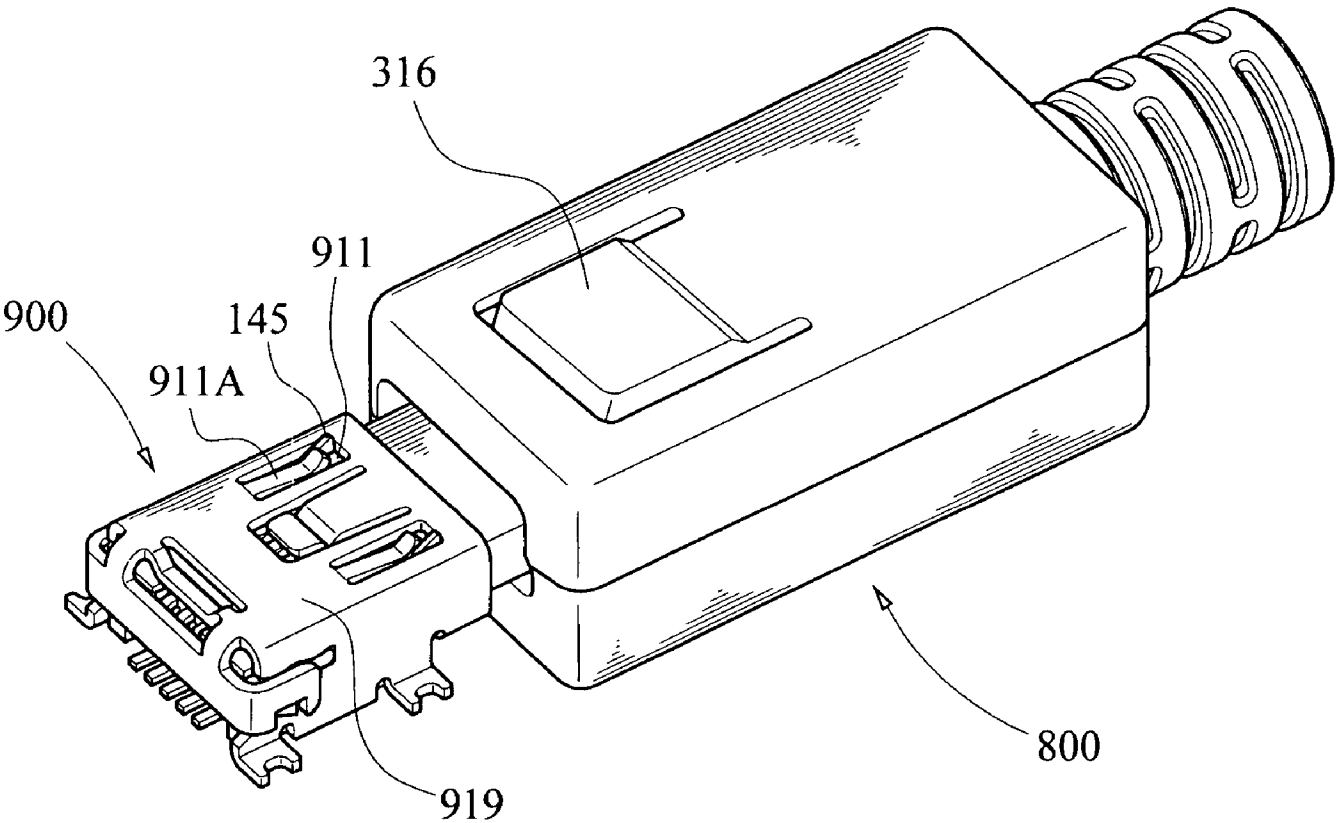
FIG. 2 is a perspective view of the assembled USB connector.

Referring to FIGS. 1 to 12, there is shown a USB connector constructed in accordance with a preferred embodiment of the invention. The USB connector comprises a plug 800 coupled to a cable at one end and a jack 900 adapted to couple to the other end of the plug 800. The jack 900 is fixed to a circuit board of a computer and the plug 800 is provided at an end of a cable extended from a peripheral. The plug 800 comprises a latch device 10, a metal case member 20, a plastic housing 30, and a cable enlargement 40. The latch device 10 comprises an insulative base 15, a first conductor assembly 13, and two elongate flexible members 14. The case member 20 comprises an inner piece 21 and an outer piece 22. The housing 30 comprises an upper shell 31 and a lower shell 32.

Figure 3:
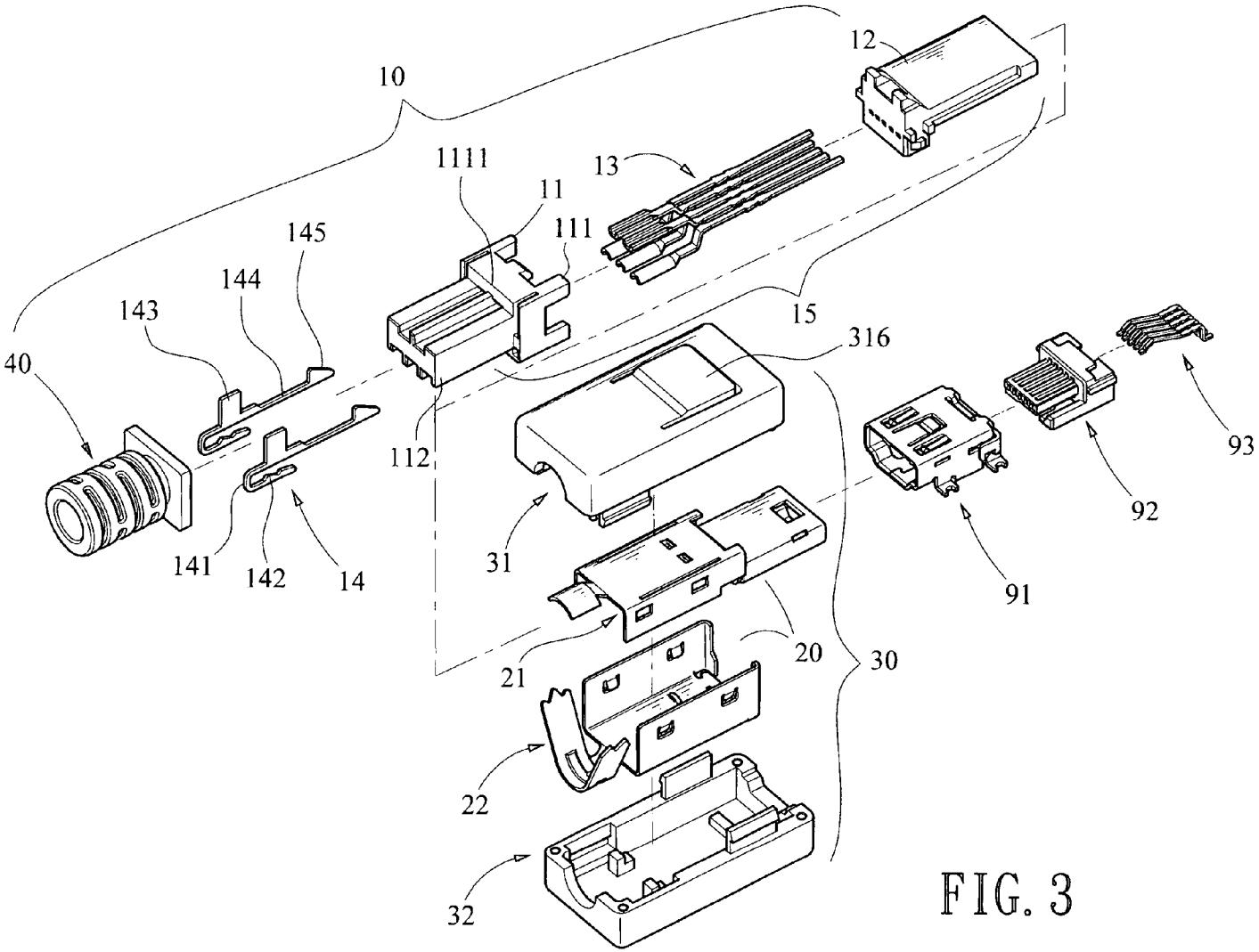
FIG. 3 is an exploded view of the USB connector.
Figure 4:
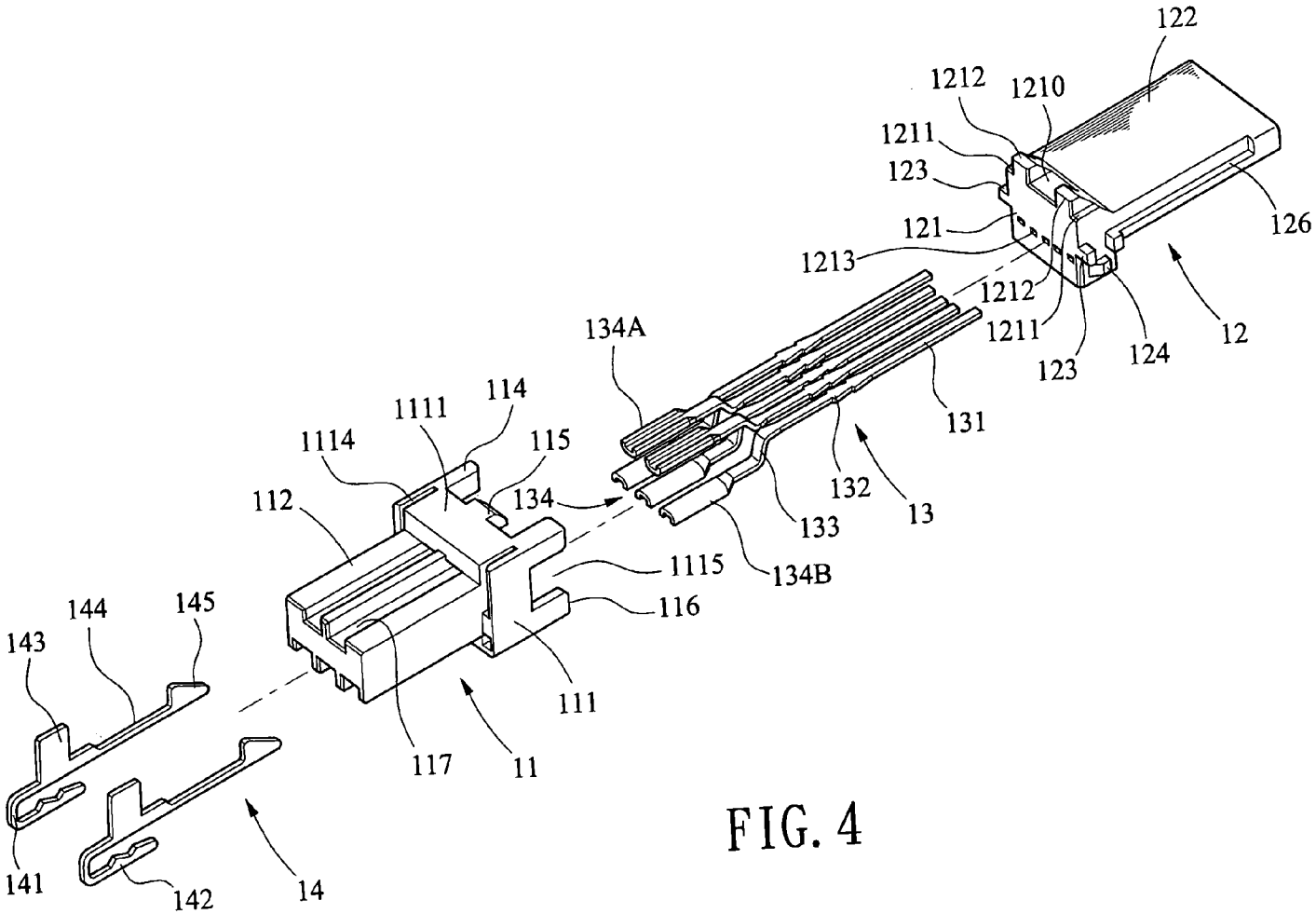
FIG. 4 is an enlarged view of the latching device shown in FIG. 3.
Figure 5:
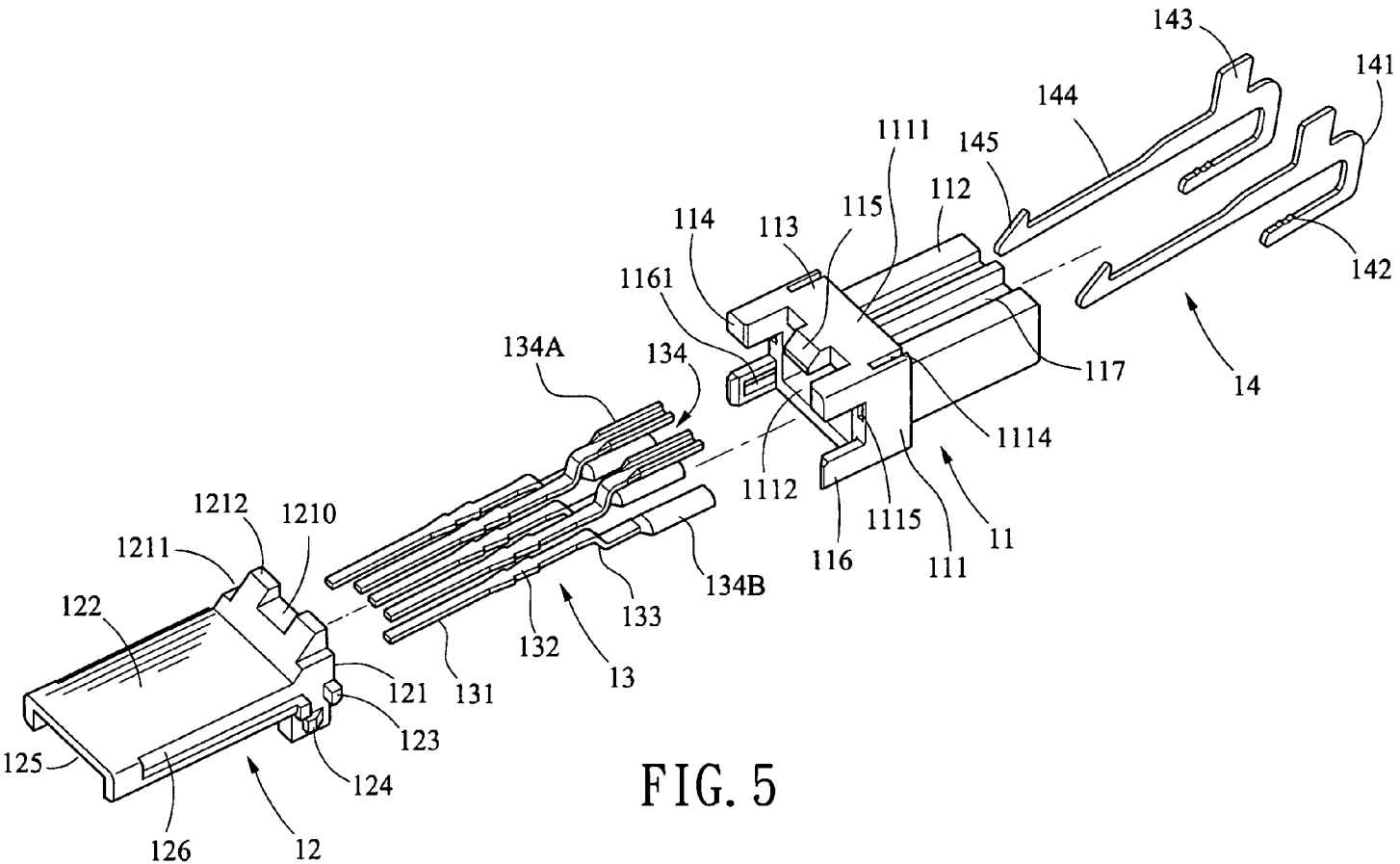
FIG. 5 is another enlarged view of the latching device shown in FIG. 3 viewed from an opposite angle.

The insulative base 15 is comprised of an insulative member 11, a mating member 12, and the first conductor assembly 13. The insulative base 15 is provided for cooperating with the flexible member 14.As shown in FIGS. 3-5, the insulative member 11 is substantially elongate in shape and comprises a rectangular body 111 at the other end and a connecting member 112 opposite the body 111. The body 111 comprises a connecting element 1111 and a first cavity 1112 in communication with a plurality of parallel top and bottom channels 117 of the connecting member 112. The first conductor assembly 13 comprises a plurality of conductors each having a contact portion 131, a fixing portion 132, a bending portion 133, and a solder portion 134 of U section. The conductors of the first conductor assembly 13 are arranged as upper and lower portions, that is, the first conductor assembly 13 further comprises some of the bending portions 133 upward and then horizontally extending to form an upper solder portion 134A and some of the bending portions 133 downward and then horizontally extending to form a lower solder portion 134B. The solder portions 134 of the upper solder portion 134A are thus spaced from that of the lower solder portion 134B, as shown in FIGS. 3, 4, 5 and 10.

The first conductor assembly 13 is received in the first cavity 1112. Two upper projections 114 are provided at both sides of the connecting element 1111. A first protrusion 115 is provided between the upper projections 114. Two lower projections 116 are provided at both lower sides of the connecting element 1111. The lower projection 116 comprises an inner tunnel 1161. A slot 1114 is provided on either side of a top 113 of the connecting element 1111. A recess 1115 is formed between the upper and lower projections 114 and 116 at either side. The recess 1115 is disposed above the tunnel 1161.

The flexible member 14 comprises a U-shaped member 141 formed by bending one end, a claw 145 at the other distant long end, a toothed member 142 at one end near the U-shaped member 141, a protuberance 143 proximate the U-shaped member 141 opposite the toothed member 142, and a flexible long arm 144 extended between the claw 145 and the protuberance 143. Note that the USB connector of the present invention thus can maintain its quality after many times of plugging or unplugging due to the provision of the flexible member 14 having an independent flexible long arm 144 extended between the claw 145 and the protuberance 143 and resting on the first grooves 126 after inserting the arms 144 through the recesses 1115.

The mating member 12 and the first conductor assembly 13 are formed integrally by insert molding. The mating member 12 comprises a rear enlarged seat 121 and a front flat plate 122. On the top of the mating member 12, an intermediate dent 1210, two side indentations 1211, and two first projections 1212 each disposed between the indentation 1211 and the dent 1210 are provided. Both a second protrusion 123 and an adjacent first tab 124 are provided at either side of the rear seat 121. The first tabs 124 are snugly received in the tunnels 1161 for securing the mating member 12 to the insulative member 11. The front plate 122 comprises an underside first trough 125 for receiving the connecting portion 131 and the fixing portion 132, and two elongate first grooves 126 at both sides for permitting the flexible arms 144 and claws 145 to place thereon after inserting the arms 144 through the recesses 1115 until being stopped. Also, at this position the protuberances 143 are securely anchored in the slots 1114 and the toothed members 142 are securely anchored in a rear portion of the tunnels 1161. These components 1210, 1212., 1211, 123, and 124, are matingly coupled to the first protrusion 115, the upper projections 114, the recesses 1115, and the tunnels 1161, respectively when the insulative member 11 and the mating member 12 are coupled and fastened together.

Figure 6:
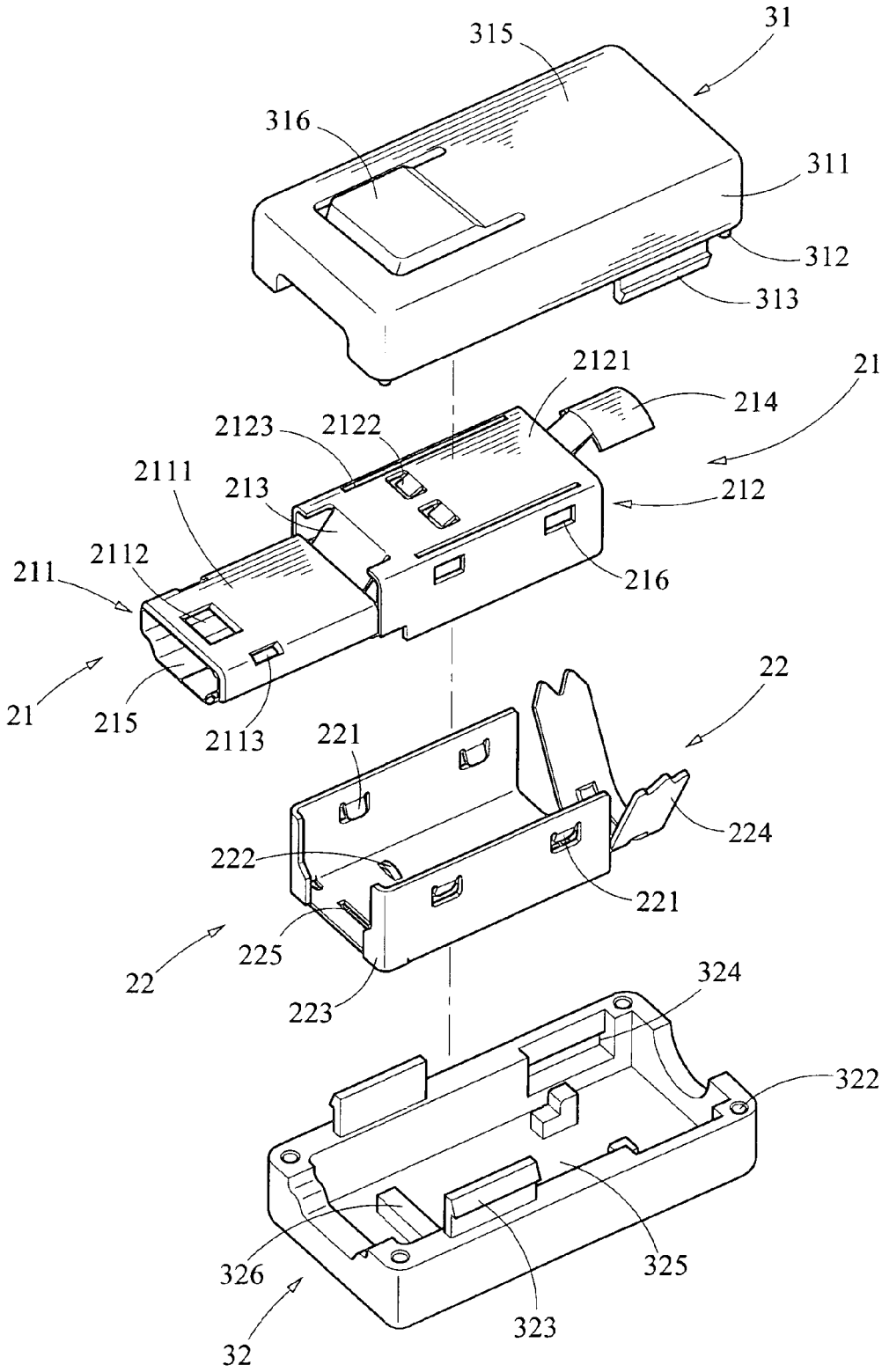
FIG. 6 is an enlarged view of the housing shown in FIG. 3 viewed from an opposite angle.

As shown in FIG. 6, the inner piece 21 comprises a front member 211, a rear member 212, and a ramp 213 for connecting the front and rear members 211 and 212 together. An arcuate member 214 is extended from one end of the rear member 212. A space 215 is defined by the front member 211 to receive the mating member 12. A first opening 2112 is provided on a top 2111 of the front member 211. A slit 2113 is provided at either side of the front member 211. The arms 144 pass the first grooves 126 to cause the claws 145 to insert through the slits 2113 to project from the inner piece 21. A transverse rib (not shown) is provided on an underside of the front member 211 to insert in a slit 225 of the outer piece 22 for fastening both the inner and outer pieces 21 and 22 together. The rear member 212 is a case element and comprises two cantilever first latches 2122 on a top 2121 thereof. A slit 2123 is provided along either top edge of the rear member 212 for positioning the protuberance 143 therein. Two second openings 216 are provided on either side of the rear member 212. Two cantilever second latches 221 are provided on either sidewall of the outer piece 22. The second latches 221 are adapted to insert into the second openings 216 for fastening the inner and outer pieces 21 and 22 together.

A plurality of second tabs 222 are provided on a bottom of the outer piece 22. The second tabs 222 are urged against a bottom of the insulative member 11 for fastening the insulative member 11 in the outer piece 22. A space is defined by two opposite front members 223 and is adapted to substantially conform to and receive the front member 211 therein. A rear bent member 224 of the outer piece 22 is provided to cooperate with the arcuate member 214 to clamp the cable 41 when the inner and outer pieces 21 and 22 are coupled together.

The housing 30 is adapted to enclose the assembled case member 20. The upper shell 31 is a constructed to mating engage with the lower shell 32 and comprises a third latch 313 extended downwardly from either first sidewall 311, four corner pegs 312, and two wells (not shown) on both sides. The mated lower shell 32 comprises four corner holes 322 with the pegs 312 inserted thereinto, two upright fourth latches 323 on both sides, and two wells 324 on both inner sides thereof. The fourth latches 323 are adapted to insert in the wells of the upper shell 31 and the third latches 313 are adapted to insert in the wells 324 of the lower shell 32 for fastening the upper and lower shells 31 and 32 together. A push member 316 is formed on top 315 of the upper shell 31. A bar 326 is provided on bottom 325 of the lower shell 32. Pressing the push member 316 will exert a force on the protuberances 143 and urge against the bar 326 so as to lower the claw 145 by pressing down the arm 144. As such, the latching device 10 is prevented from malfunctioning due to excessive pressing. As a result, the USB connector can maintain its quality after many times of plugging or unplugging.

Note that the cable enlargement 40 is a well known member. Thus, a detailed description thereof is omitted herein for the sake of brevity.

Figure 7A:
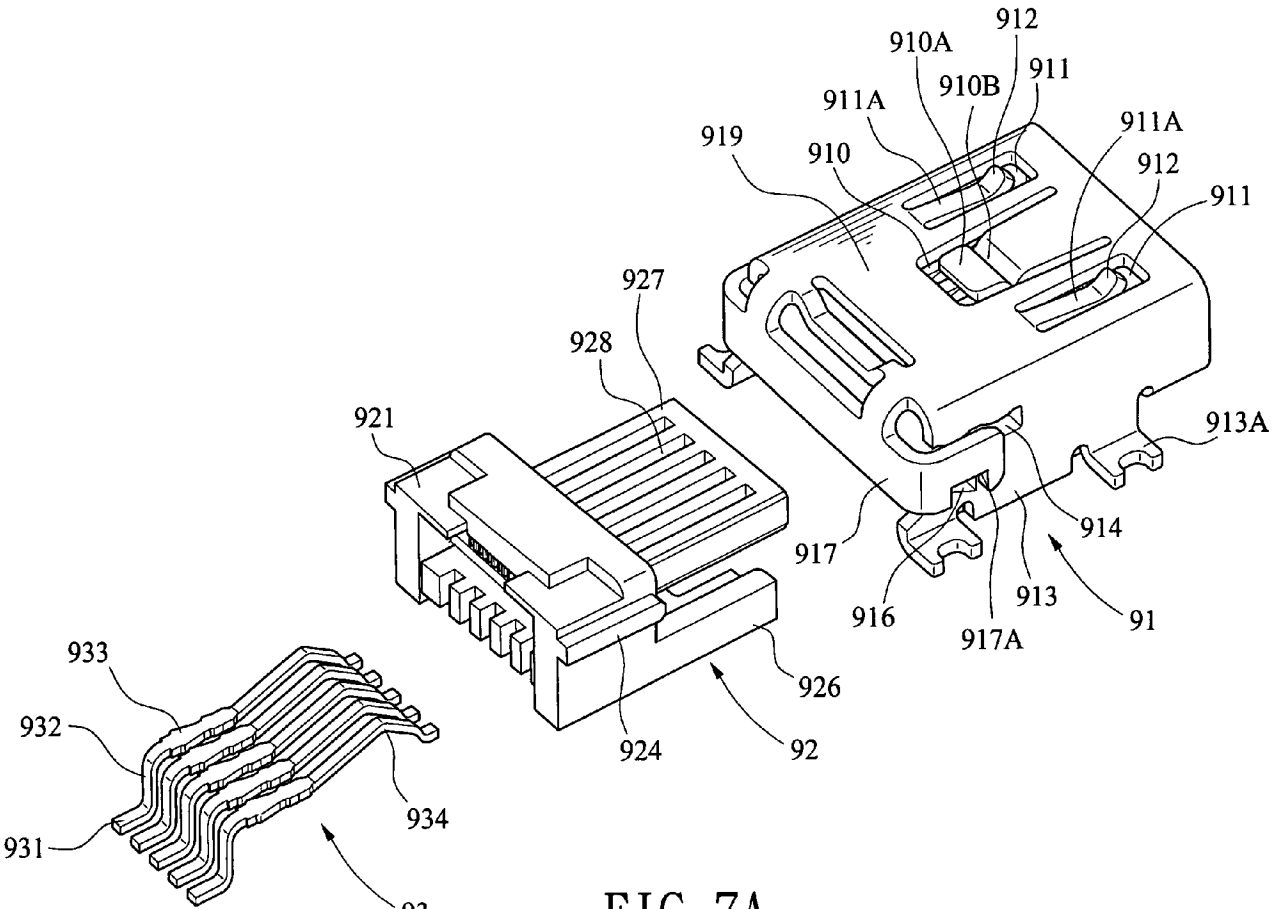
FIG. 7A is an enlarged view of the jack shown in FIG. 3 viewed from an opposite angle.
Figure 7B:
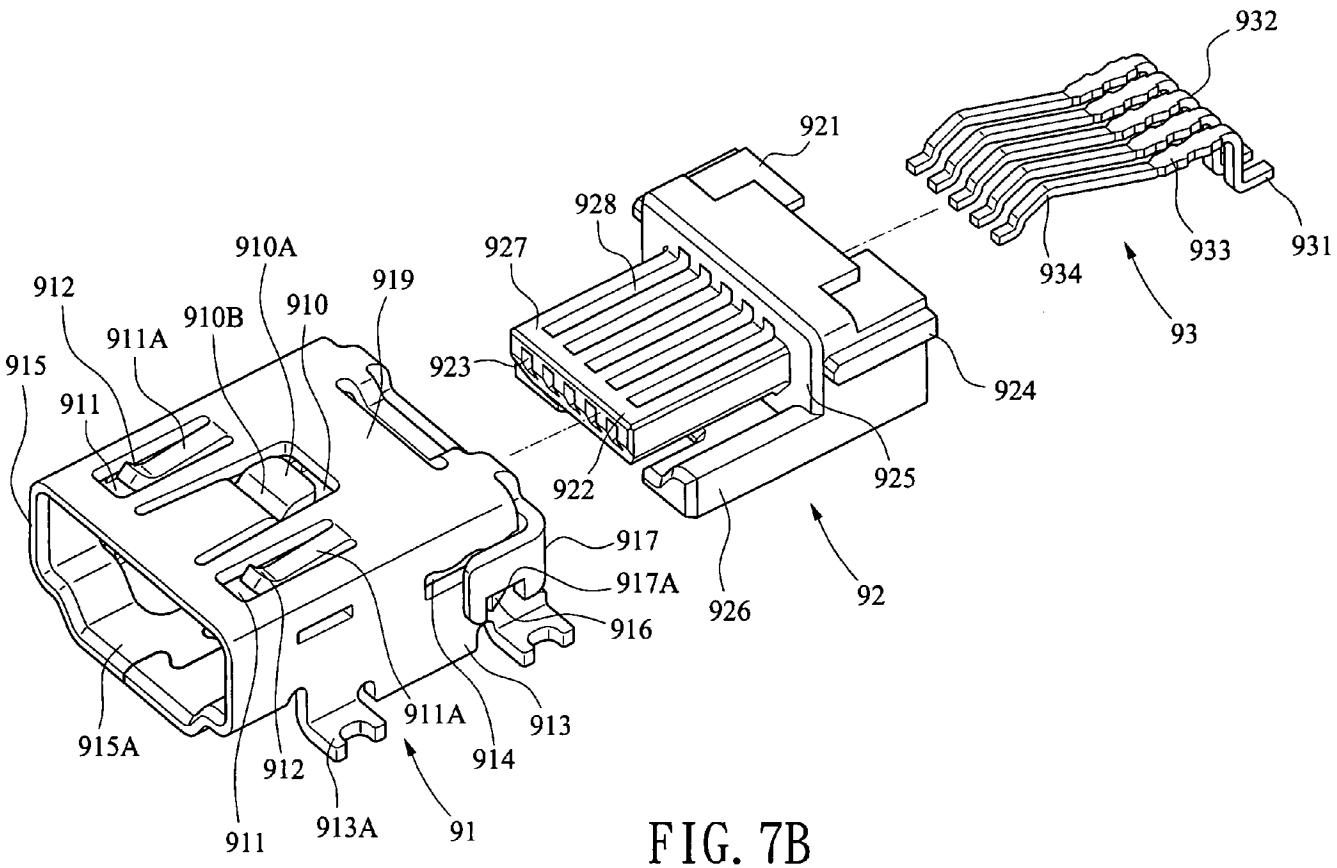
FIG. 7B is another enlarged view of the jack shown in FIG. 3.
Figure 8:
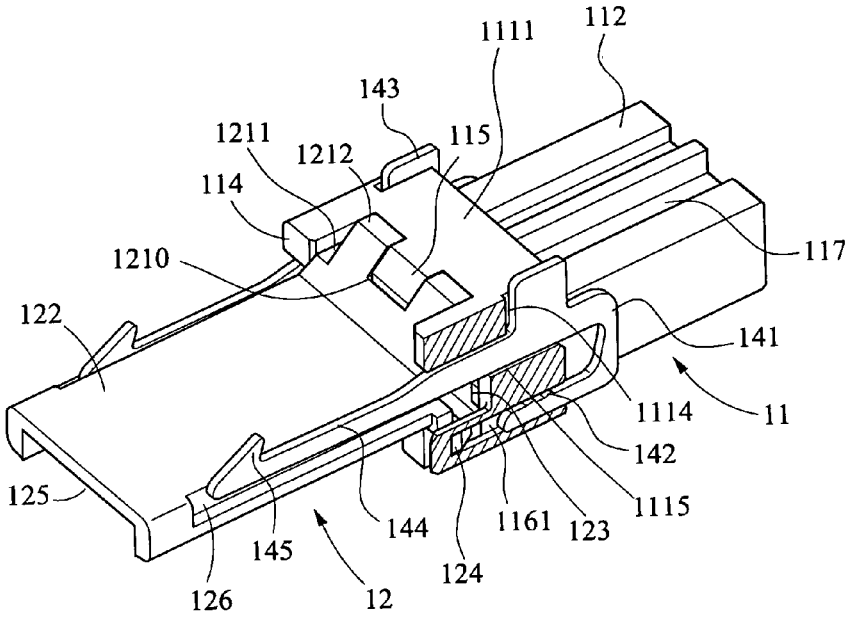
FIG. 8 is a perspective view of the assembled insulative member, mating member, and flexible member.
Figure 9:
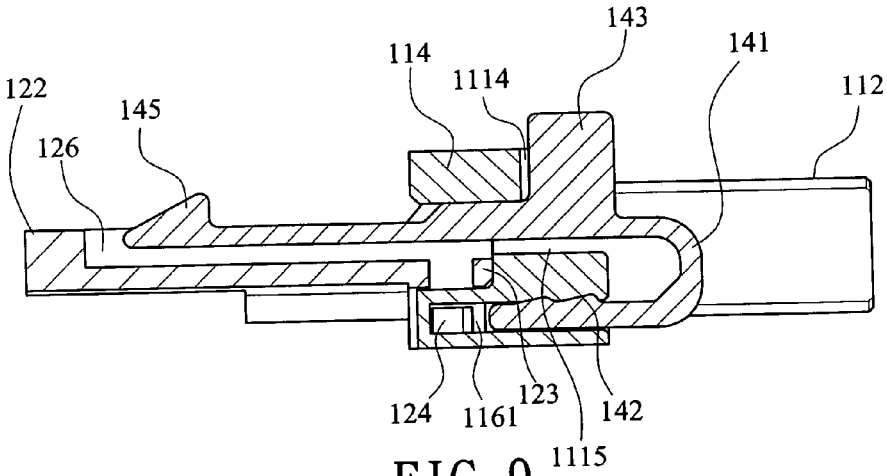
FIG. 9 is a sectional view of FIG. 8.
Figure 10:
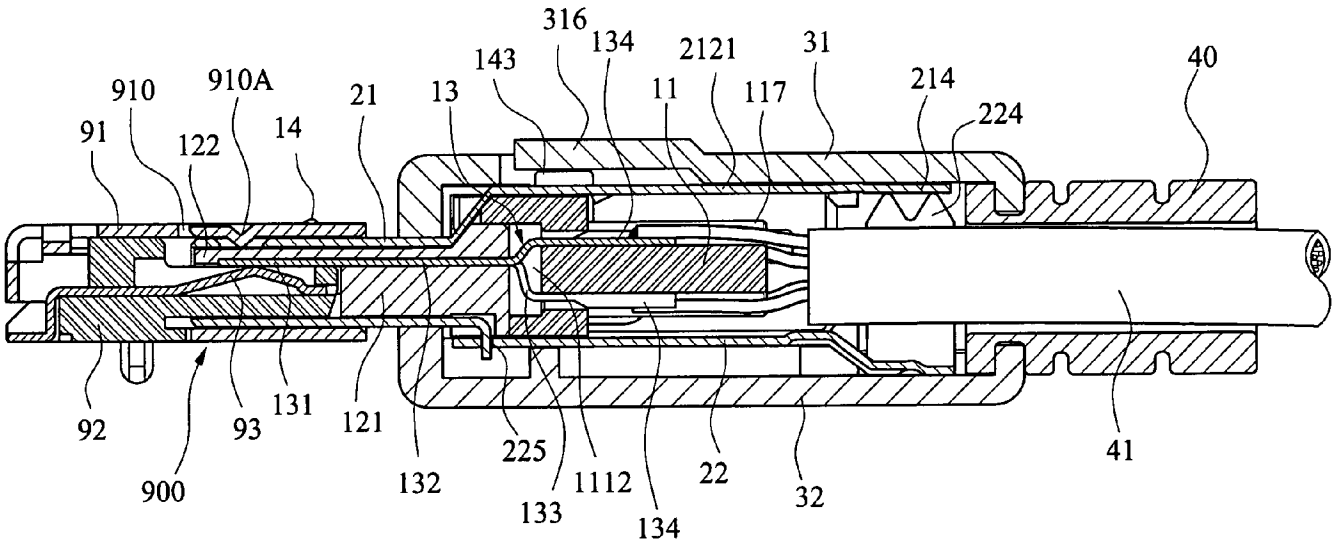
FIG. 10 is a sectional view of the assembled USB connector.

Referring to FIGS. 7A and 7B specifically, the jack 900 comprises a shield shell 91, an insulative unit 92, and a second conductor assembly 93. The insulative unit 92 comprises an intermediate wall 925, two flat side guides 921 at one end, a mating element 927 at the other end, a plurality of parallel second grooves 928 on the mating element 927, a plurality of parallel apertures 923 in a front of the mating element 927, two side rails 924 proximate the guides 921, and two side L shaped supports 926.

The shield shell 91 comprises two second sidewalls 913 and a top face 919 interconnecting the second sidewalls 913. The top face 919 comprises a first slot member 910, a first cantilever member 910A having a V-shaped groove 910B in the first slot member 910, two second slot members 911 each being smaller than the first slot member 910 and disposed at either side thereof, and two second cantilever members 911A having an upward bent end 912 in the second slot member 911. The extending direction of the first cantilever member 910A is opposite to that of either second cantilever member 911A.

The shield shell 91 further comprises a third opening 915 formed at one end having a reduced bottom 915A for receiving the insulative unit 92, a bent extension 917 formed at the other end, the extension 917 having a rectangular second cavity 917A at either end, two third protrusion 916 each projected from the second sidewall 913 to the second cavity 917A, four flat mounting legs 913A extended laterally from either second sidewall 913 to be adapted to secure onto the circuit board by, for example, soldering, and two second troughs 914 at both side.

The second conductor assembly 93 comprises a plurality of elongate parallel conductors each including a soldering portion 931, a vertical portion 932 adjacent the first terminal 931, a fixing portion 933 connected with the vertical portion 932 and fixed in the insulative unit 92, and a bent portion 934 connected with the fixing portion 933 and rested on the second grooves 928 and extended from the apertures 923;

In the assembled state, the conductors of the second conductor assembly 93 are disposed in the apertures 923. The insulative unit 92 is enclosed by the shield shell 91. The rails 924 are snugly received in the second troughs 914 for fastening the insulative unit 92 in the shield shell 91. The third protrusions 916 are latched in the second cavities 917A. As a result, the jack 900 is assembled.

An assembly of USB connector of the invention will be described in detailed below. Firstly, urge the mating member 12 against the insulative member 11. Also, the indentations 1211, the dent 1210, the first projections 1212, and the second protrusions 123 are matingly coupled to the respective portions of the upper projections 114, the first protrusion 115, and the recesses 1115 of the insulative member 11. Also, the first tabs 124 are inserted into the tunnels 1161 for fastening the mating member 12 and the insulative member 11 together. Next, insert the U-shaped members 141 and the arms 144 of the flexible members 14 through the slots 1114 and the recesses 1115 of the insulative member 11 with the claws 145 and the arms 144 of the flexible members 14 passed the recesses 1115 to rest on the first grooves 126 and the U-shaped members 141 fastened in the tunnels 1161 of the insulative member 11.

Secondly, couple the inner piece 21 and the above assembled components of the latch device 10 together. Then couple the inner piece 21 and the outer piece 22 together with the second and first latches 221 and 2122 inserted into the second openings 216 for fastening. Also, the first and second latches 2122, 221 and the second tabs 222 are urged against the assembled components in the first stage. As such, these components are fastened within the case member 20.

Thirdly, enclose the assembled components in the second stage and the cable enlargement 40 in the housing 30 so as to fasten them together by snapping the upper shell 31 to the lower shell 32. At this position, the push member 316 is urged by the protuberances 143 of the flexible members 14. This finishes the assembly of the invention as shown in FIG. 1.

Note that the first conductor assembly 13 having the above construction is adapted to prevent short circuit from occurring due to erroneous coupling of the jack 900 and the plug 800. As shown in FIGS. 3, 4, 5 and 10, in detail, the contact portion 131 of each conductor of the first conductor assembly 13 is individually inserted through respective holes 1213 of The enlarged seat 121 of the mating member 12. The bending portion 133 and the U-shaped solder portion 134 of each conductor of the first conductor assembly 13 connecting with each conductor of the cable 41 are fastened in the first cavity 1112 and the lop and bottom channel 117 (see FIG. 10) respectively. The insulative base 15 consists of the insulative member 11 and the mating member 12. Both of the insulative member 11 and the mating member 12 are assembled together by securing the components 1210, 1211, 1212, 123, and 124, to the components 114, 115, 1115, and 1161. The assembled insulative member 11 and the mating member 12 are thus firmly secured together. Further, the toothed member 142 and the protuberance 143 of the flexible member 14 are secured in the inner tunnel 1161 and the slot 1114 respectively. Also, the flexible arm 144 and claw 145 of the flexible member 14 are rested on the first groove 126 of the mating member 12 after inserting the arm 144 through the recess 1115. As such, the insulative member 11 and the mating member 12 are further positively secured together (see FIGS. 8 and 9).

Figure 11:
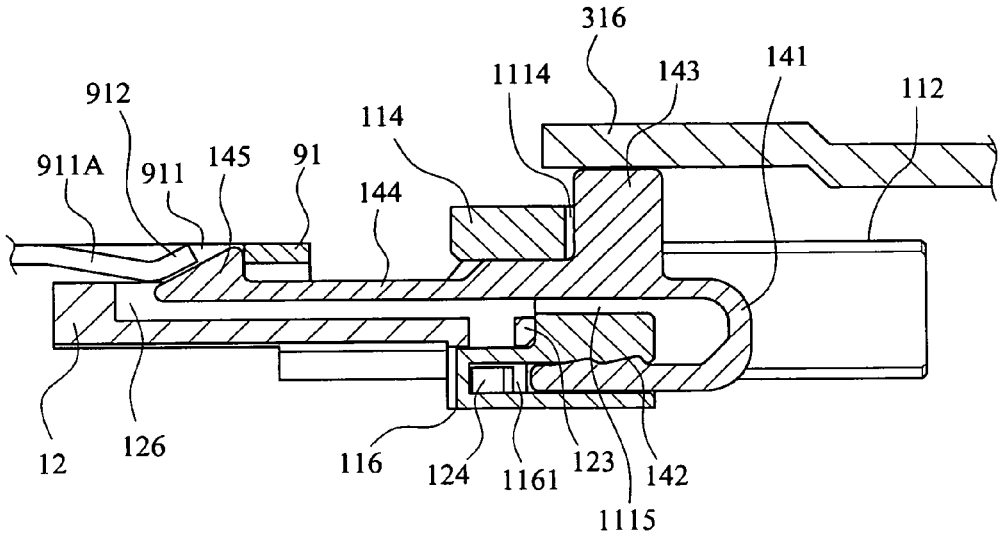
FIG. 11 is an enlarged view of a portion of FIG. 10.

As shown in FIG. 11, the claw 145 is sandwiched by and between the upward bent end 912 of the second cantilever member 911A and the shield shell 91 in the second slot member 911 in a fastened state of the USB connector. In this state, the conductors of the first conductor assembly 13 and the conductors of the second conductor assembly 93 are electrically connected together and the connection is positively secured and greatly reliable.

Figure 12:
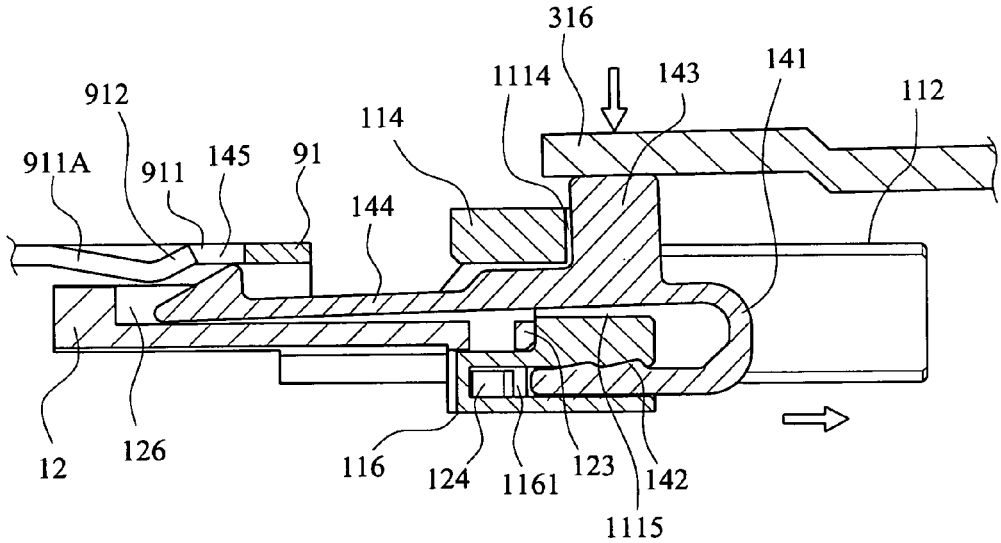
FIG. 12 is a view similar to FIG. 11 where the plug and the jack are disengaged by pressing the push member.

As shown in FIG. 12, for separating the jack 900 from the plug 800 it is possible of pressing the push member 316 to exert a force on the protuberances 143 to lower the claw 145 by pressing down the arm 144. The claw 145 thus clears the gap between the upward bent end 912 of the second cantilever member 911A and the shield shell 91 in the second slot member 911. Such disengagement is easy, as a small downward movement of the protuberances 143 will make a great increment downward of the movement of the claw 145 to clear the gap.

While the invention herein disclosed has been described by means of specific embodiments, numerous modifications and variations could be made thereto by those skilled in the art without departing from the scope and spirit of the invention set forth in the claims.

What is claimed is:

1. A USB connector comprising:

a plug (800) at one end coupled to a cable (41) extended from a peripheral, the plug (800) comprising an insulative member (11), a mating member (12), a first conductor assembly (13) having a plurality of conductors, two elongate flexible members (14), a metal case member (20) including an inner piece (21) and an outer piece (22), and a plastic housing (30) including an upper shell (31) and a mated lower shell (32); and a jack (900) fixed to a circuit board and adapted to couple to the other end of the plug (800), the jack (900) comprising a shield shell (91), an insulative unit (92), and a second conductor assembly (93) having a plurality of conductors; wherein the insulative member (11) comprises a rectangular body (111) including a connecting element (1111), a cavity (1112) inside the rectangular body (111), two upper projections (114) at both sides of the connecting element (1111), a first protrusion (115) provided between the upper projections (114), two lower projections (116) provided at both lower sides of the connecting element (1111), the lower projection (116) including an inner tunnel (1161), two slots (1114) provided on both sides of a top (113) of the connecting element (1111), two recesses (1115) each formed between the upper and lower projections (114) and (116) at either side and disposed above the tunnel (1161), and a connecting member (112) opposite the body (111) and including a plurality of parallel top and bottom channels (117) in communication with the cavity (1112);

the mating member (12) comprises a rear enlarged seat (121) including a plurality of holes (1213) on a rear end, an intermediate dent (1210), two side indentations (1211), and two first projections (1212), each disposed between the indentation (1211) and the dent (1210), a second protrusion (123) and an adjacent tab (124) both at either side of the rear seat (121), and a front flat plate (122) including an underside trough (125), and two elongate grooves (126) at both sides of the front flat plate (122);

the first conductor assembly (13) comprises a plurality of conductors each having a contact portion (131), a fixing portion (132), a bending portion (133), and a solder portion (134) of U section;

the elongate flexible member (14) comprises a U-shaped member (141) formed at one end, a claw (145) at the other distant end, a toothed member (142) at one end connected with the U-shaped member (141), a protuberance (143) proximate the U-shaped member (141) opposite the toothed member (142), and a flexible long arm (144) extended between the claw (145) and the protuberance (143);

the inner piece (21) comprises a front member (211) and a rear member (212), the rear member (212) including two first latches (2122) on its top (2121), and a slit (2123) provided along its either top edge for positioning the protuberance (143); the front member (211) including a space (215) defined by the front member (211), an opening (2112) on a top (2111) of the front member (211), and a slit (2113) at either front side of the front member (211);

the outer piece (22) comprises a rear bent member (224);

the upper shell (31) comprises four corner pegs (312) and a top push member (316);

the lower shell (32) comprises four corner holes (322) with the pegs (312) inserted thereinto;

the shield shell (91) comprises a top first slot member (910), a top first latch (910A) having a V-shaped groove (910B) in the first slot member (910), two second slot members (911) each being smaller than the first slot member (910) and disposed at either side thereof, and two second latches (911A) having an upward bent end (912) in the second slot member (911), an extending direction of the first latch (910A) being opposite to that of either second latch (911A);

wherein the first conductor assembly (13) is inserted in the underside trough (125) of the mating member (12) through the holes (1213) of the enlarged seat (121) with the contact portion (131) and the fixing portion (132) of each conductor thereof, and the bending portion (133) and the U-shaped solder portion (134) of each conductor thereof is fastened in the cavity (1112) and the top and the bottom channels (117) respectively;

wherein the mating member (12) is urged against the insulative member (11) to matingly engage the indentations (1211), the dent (1210), the first projections (1212), and the second protrusions (123) with the upper projections (114), the first protrusion (115), and the recesses (1115) of the insulative member (11), and to insert the tabs (124) into a front portion of the tunnels (1161);

wherein the claws (145) and the arms (144) of the elongate flexible members (14) are inserted through the recesses (1115) of the insulative member (11) to sandwich either claw (145) in a gap between the upward bent end (912) of the second latch (911A) and the shield shell (91) in the second slot member (911), to rest the arms (144) on the grooves (126), to fasten the protuberances (143) in the slots (1114), and fasten the toothed members (142) in a rear portion of the inner tunnels (1161); and wherein the push member (316) is urged by the protuberances (143) of the flexible members (14), and the first and second conductor assemblies (13) and (93) are electrically connected together in the jack (900);

whereby pressing the push member (316) to exert a force on the protuberances (143) will lower and cause the claw (145) to clear the gap between the upward bent end (912) of the second latch (911A) and the shield shell (91) in the second slot member (911) prior to separating the plug (800) from the jack (900).

2. The USB connector of claim 1, wherein the lower shell (32) further comprises a bottom bar (326) in an inner bottom of the lower shell (32), the push member (316) is adapted to urge against the bottom bar (326) in response to the pressing during unplugging the connector.

3. The USB connector of claim 1, wherein the first conductor assembly (13) further comprises some of the bending portions (133) upward and then horizontally extending to form an upper solder portion (134A) and some of the bending portions (133) downward and then horizontally extending to form a lower solder portion (134B).

* * * * *